US006119740A

United States Patent [19]

Wilham, Jr. et al.

[11] Patent Number: 6,119,740

[45] Date of Patent: Sep. 19, 2000

[54] SAND BAG FILLER

[76] Inventors: Keith H. Wilham, Jr., 17229 NE. 40th St. Suite D, Redmond, Wash. 98052; Keith H. Wilham, Sr., 215 E. Flora, Mt. Pulaski, Ill. 62548

[21] Appl. No.: 09/243,932

[22] Filed: Feb. 3, 1999

[51] Int. Cl.[7] ..... B65B 1/04

[52] U.S. Cl. ..... 141/391; 141/313; 222/556

[58] Field of Search ..... 141/391, 313, 141/317, 114; 222/180, 181.1, 181.2, 556, 469

[56] References Cited

U.S. PATENT DOCUMENTS 1,639,517 8/1927 Lassen ..... 141/317

2,366,163 1/1945 Vredenburg ..... 141/317

2,806,489 9/1957 Armstrong ..... 141/317

*Primary Examiner*—Steven O. Douglas

*Attorney, Agent, or Firm*—John H. Wiegenstein

[57] ABSTRACT

This disclosure relates to devices for automatically filling sand bags with pre-measured quantities of sand. It is simple, reliable, and easily operated by unskilled workers. It is comprised generally of a chute having multiple sides and sized to hold a pre-measured quantity of sand and configured to allow the sand to flow reliably when the operator so desires, a door, and an overcenter device for opening and closing the door to allow the pre-measured quantity of sand in the chute to flow into a standard size sandbag located below the chute.

1 Claim, 3 Drawing Sheets

SAND BAG FILLER

I. CROSS REFERENCES TO RELATED APPLICATIONS

Not applicable.

II. STATEMENT AS TO RIGHTS TO INVENTIONS MADE UNDER FEDERALLY SPONSORED RESEARCH AND DEVELOPMENT

Not applicable.

III. BACKGROUND OF THE INVENTION

A. Field of the Invention

This invention relates generally to the field of devices for dispensing sand or similar materials into bags for use in flood control, erosion control, and related needs.

B. Description of the Related Art

Sand bags are a well known means of providing persons and property with temporary protection from flooding due to severe weather, natural disasters, and other causes. The bags, which are made of natural or synthetic fibers, are filled with sand at or near the location where they are to be used. Currently, the bags are typically filled manually by a person using a shovel to load sand into the bag. The number of bags which a person can fill by this method in a given amount of time is limited, and this method also rapidly fatigues the person filling the bags. Work related injuries such as back strains and cut hands are also frequent with this method of filling.

Efforts have been made to use devices such as bins or hoppers to fill sand bags quicker and with less fatigue to the operator. However, because of the physical properties of sand, the physical dimensions and geometry of such devices must be carefully controlled for the device to work. In addition, due to the weight of the sand in the bin or hopper, a simple and secure means of controlling flow from the hopper into the bag is required. Also, a large bin or hopper does not provide consistent, pre-measured quantities of sand for each bag.

IV. SUMMARY OF THE INVENTION

In view of the foregoing, it is the object of the invention to develop a sand bag filler which can be attached to a suitably configured bin or hopper holding a large quantity of sand, and which dispenses consistent measured quantities of the sand into standard size bags and allows easy handling and securing of the filled bags. The invention provides at least the following:

A. A means for holding a pre-measured quantity of sand;

B. Reliable, consistent dispensing of sand into bags;

C. Simple operation by unskilled operators; and

D. Simple, robust construction for low cost, durability and damage tolerance.

V. BRIEF DESCRIPTION OF THE DRAWINGS

The invention may be better understood by reference to the accompanying drawings.

VI. DESCRIPTION OF THE PREFERRED EMBODEMENT(S)

Figure 1:
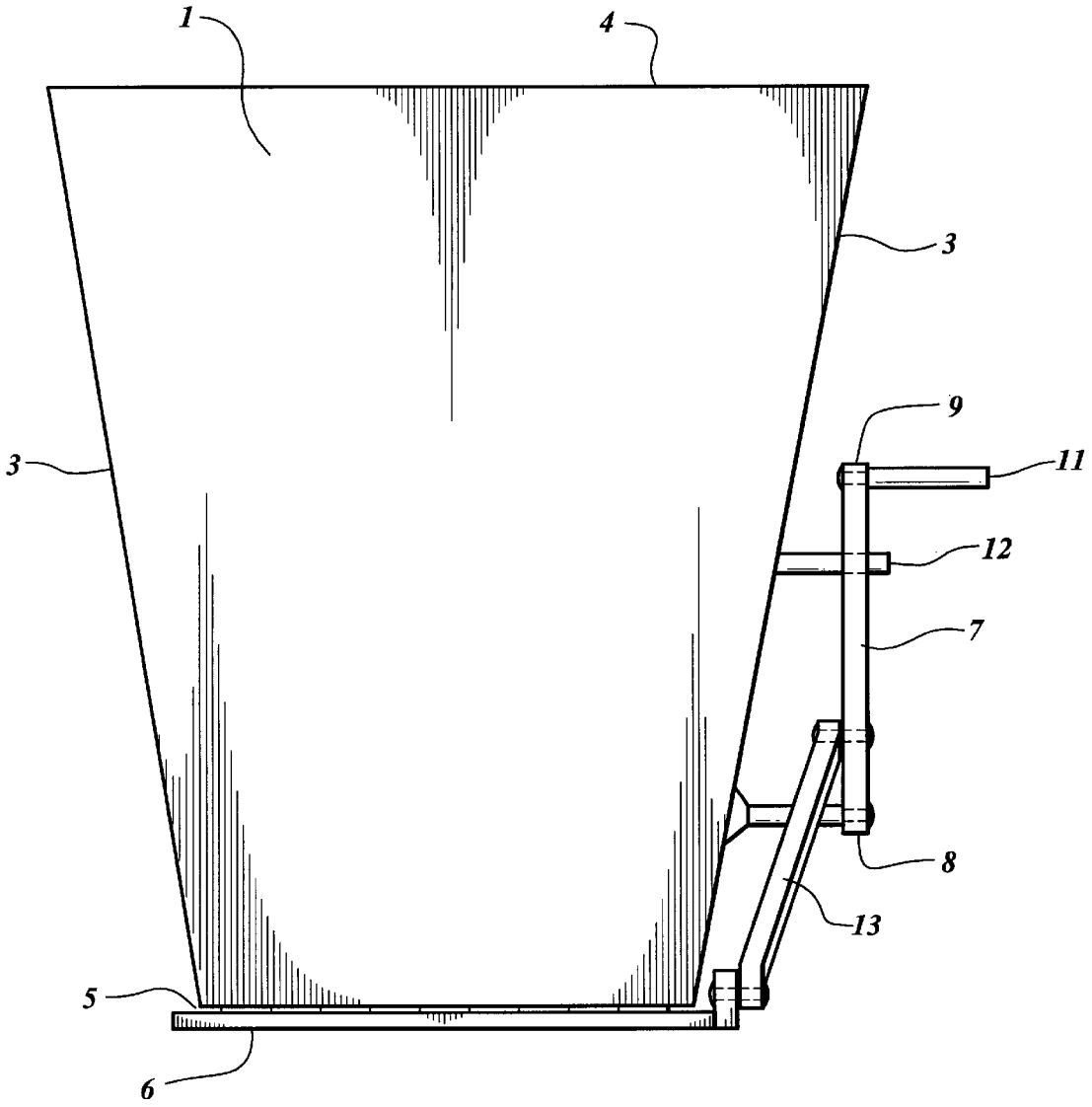
FIG. 1 shows a frontal view of the invention.
Figure 2:
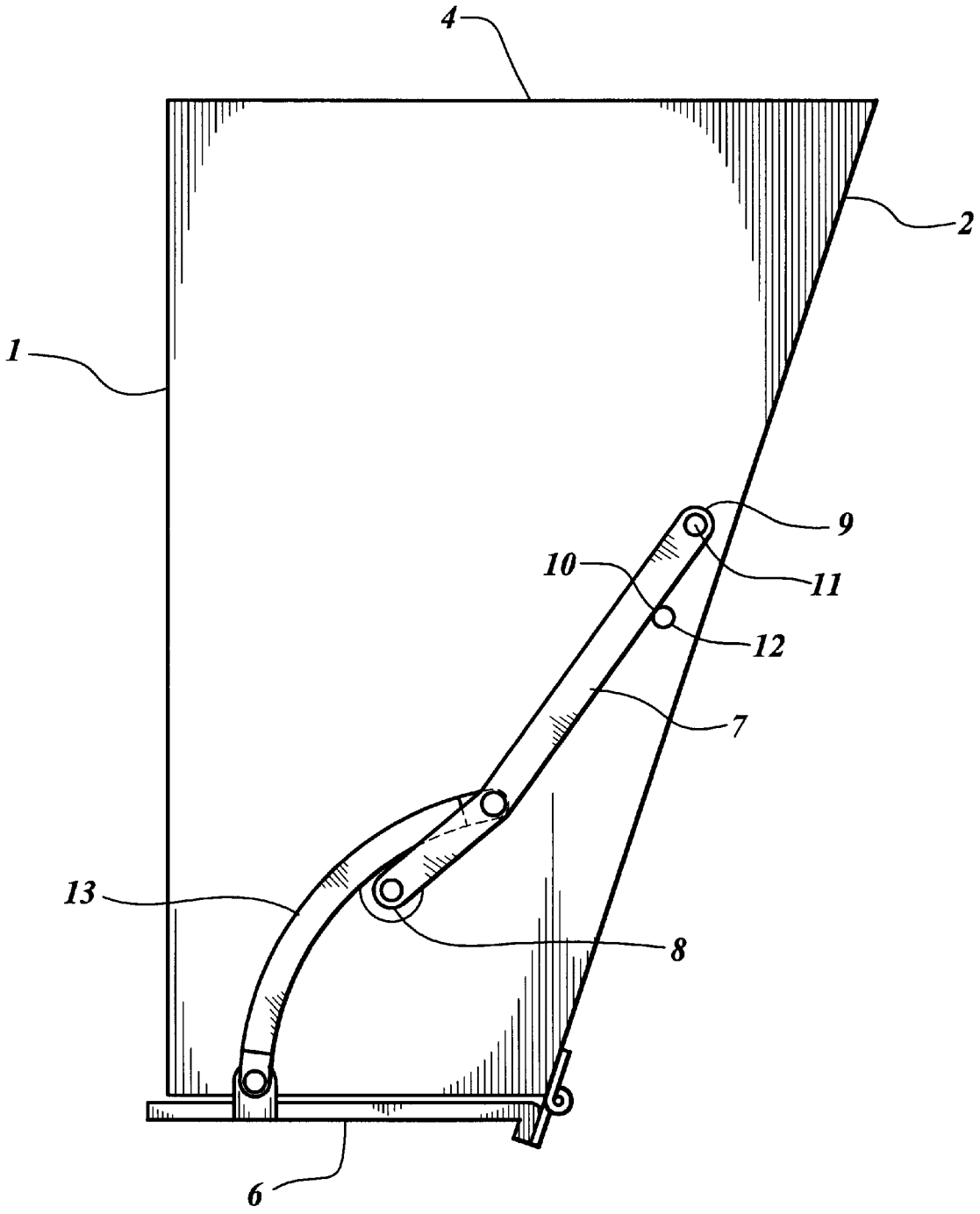
FIG. 2 shows a side view with the operating mechanism closed.
Figure 3:
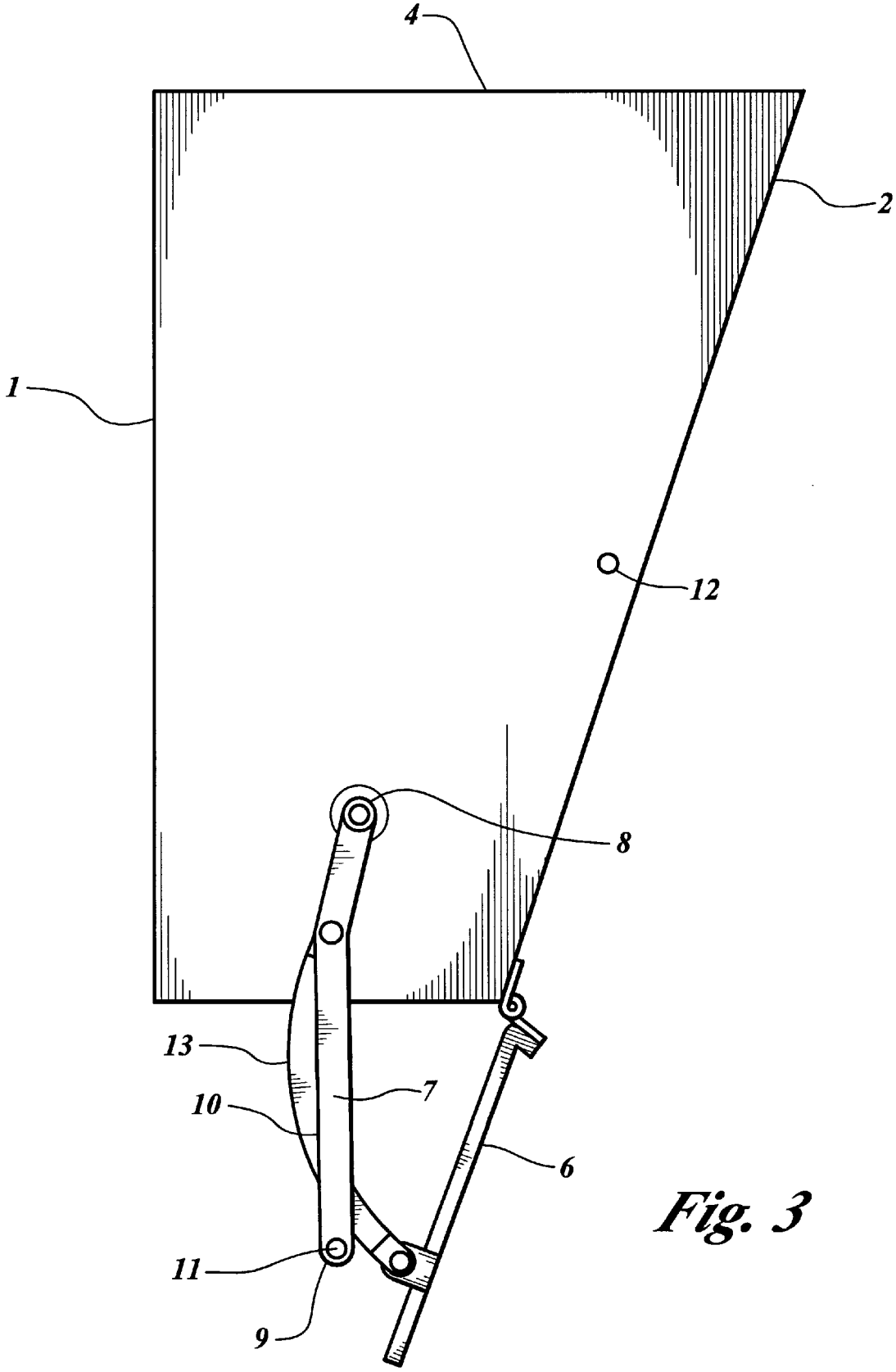
FIG. 3 shows a side view with the operating mechanism open.

In its preferred embodiment the invention comprises a steel chute having a front face 1, rear face 2, and opposing side faces 3. Front face 1, rear face 2, and opposing side faces 3 each have upper ends 4 and lower ends 5. Front face 1 lies in a vertical plane, and rear face 2 lies in a plane inclined 20° from the vertical. Opposing side face 3 lie in planes perpendicular to the planes containing front face 1 and rear face 2, and inclined 12° from the vertical. The lower ends 5 of front face 1, rear face 2, and opposing side faces 3 form a rectangular orifice having an area of 62 square inches, with the upper ends of front face 1, rear face 2, and opposing side faces 3 forming a larger opening. The distance between upper ends 4 and lower ends 5 on front face 1, rear face 2, and opposing side faces 3 is sufficient to create an enclosed volume within the chute of at least 670 cubic inches.

The chute is removably attached below the discharge point of a suitably configured hopper or bin by conventional means such as mechanical fasteners or quick release pins. Sand from the bin or hopper is discharged into the chute until the chute is filled, the flow of sand from the bin or hopper being controlled by conventional means such as a manually operated sliding gate. Door 6 is sized so as to fully cover the orifice created by the lower ends 5 of front face 1, rear face 2, and opposing side faces 3, and is attached to the lower end of rear face 2 with a hinge. Operating lever has fixed end 8, free end 9, and contact point 10. Fixed end 8 is rotatably affixed to side face 3, and handle 11 is attached to free end 9. Stop pin 12 is affixed to side face 3. Closing link 13 is rotatably affixed to door 6 and operating lever 7, such that when operating lever 7 is pulled towards front face 1 door 6 opens downward to dispense sand stored in the chute into a standard sand bag located around the orifice formed by the lower ends 5 of front face 1, rear face 2, and opposing side faces 3. Operating lever 7 is then moved towards rear face 2 until contact point 10 contacts stop pin 12, at which point operating lever 7 and closing link 13 operate in an "overcenter" fashion to securely close door 6 against lower ends 5 of front face 1, rear face 2, and opposing side faces 3. With door 6 in the closed position the chute may be refilled with sand from the bin or hopper, and the process repeated.

It may be seen that the dimensions of front face 1, rear face 2, and opposing side faces 3 may be modified to accommodate different size sand bags, and that the configuration of lower ends of front face 1, rear face 2, and opposing side faces 3 may be altered to as to form an orifice of different cross sectional shape or size, as long as the sand bags to be used with the invention will fit over the orifice formed by the lower ends 5 of front face 1, rear face 2, and opposing side faces 3. The dimensions of door 6 would be altered accordingly so as to provide the required secure fit against the lower ends 5 of front face 1, rear face 2, and opposing side faces 3.

We claim:

1. A sand bag filler which may be removably attached to a suitably configured hopper or bin, said sand bag filler comprising a chute having a front face oriented in a reference plane, a rear face oriented between 15° and 30° from a plane substantially parallel to the reference plane, and a plurality of side faces oriented between 7° and 17° from a plane lying at an angle to the reference plane, each face having an upper end and lower end, the lower ends of the front face, rear face, and side faces forming an orifice with a cross sectional area no greater than 62 square inches, and the distance between the lower ends and upper ends of the front face, rear face, and side faces creating an internal volume in the chute of at least 550 cubic inches;

a door hingedly affixed to the lower end of the rear face;

an operating lever having a fixed end rotatably affixed to one side face, a free end, and a contact point located between the fixed end and the free end;

a stop pin affixed to the same side face as the operating lever; and a closing link which connects the operating lever and the door in an overcenter fashion, such that the operating lever may be moved in one direction to securely close the door against the lower ends of the faces, in which position the contact point rests against the stop pin and sand in the chute increases the closing force on the door, and which may be moved in the opposite direction to open the door and allow sand contained in the chute to flow into a sandbag located below the lower ends of the faces.

* * * * *